US009355550B2

(12) United States Patent
Kensy et al.

(10) Patent No.: US 9,355,550 B2
(45) Date of Patent: May 31, 2016

(54) OPERATING STATE WARNING DEVICE

(71) Applicant: WERMA Holding GmbH + Co. KG, DE-78604 Rietheim-Weilheim (DE)

(72) Inventors: Daniel Kensy, Tuttlingen (DE); Gerhard Kuehnemundt, Emmingen-Liptingen (DE)

(73) Assignee: WERMA Holding GmbH + Co. KG, Rietheim-Weilheim (DE)

( * ) Notice: Subject to any disclaimer, the term of this patent is extended or adjusted under 35 U.S.C. 154(b) by 51 days.

(21) Appl. No.: 14/174,816

(22) Filed: Feb. 6, 2014

(65) Prior Publication Data

US 2014/0225728 A1 Aug. 14, 2014

(30) Foreign Application Priority Data

Feb. 8, 2013 (DE) ..... 10 2013 002 117

(51) Int. Cl.

| | |
|---|---|
| ***G08B 1/08*** | (2006.01) |
| ***G08B 21/18*** | (2006.01) |
| ***F21V 23/00*** | (2015.01) |
| ***G08B 3/10*** | (2006.01) |
| ***G08B 7/06*** | (2006.01) |
| ***G07C 3/00*** | (2006.01) |

(52) U.S. Cl.

CPC ..... *G08B 21/18* (2013.01); *F21V 23/00* (2013.01); *G07C 3/00* (2013.01); *G08B 3/10* (2013.01); *G08B 7/06* (2013.01)

(58) Field of Classification Search

CPC ..... F21V 23/00; G07C 3/00; G08B 21/18; G08B 3/10; G08B 7/06; B01F 11/0014; B01F 15/00155; B01F 15/00253; B01F 2215/0037; B01L 2200/023; B01L 2200/143; B01L 9/523; Y10T 436/12

USPC ..... 340/539.1, 815.4, 815.73, 679, 521, 340/517, 584, 588, 501, 438, 691.1, 692

See application file for complete search history.

(56) References Cited

U.S. PATENT DOCUMENTS

| | | | | |
|---|---|---|---|---|
| 4,820,935 | A * | 4/1989 | Gontowski | 307/112 |
| 5,744,875 | A * | 4/1998 | Kleefeldt et al. | 307/10.2 |
| 2004/0193783 | A1 * | 9/2004 | Sharma | G06F 9/5016 711/104 |
| 2010/0109897 | A1 * | 5/2010 | Hohler | 340/815.4 |
| 2010/0109900 | A1 * | 5/2010 | Marquardt | F21S 8/00 340/815.73 |
| 2012/0133282 | A1 * | 5/2012 | Rubio et al. | 315/77 |

FOREIGN PATENT DOCUMENTS

DE 20 2007 005 495 U1 10/2007

* cited by examiner

*Primary Examiner* — Daniel Previl

(74) *Attorney, Agent, or Firm* — Breneman & Georges

(57) ABSTRACT

An operating state warning device (1) for visually and/or audibly indicating at least one operating state or, respectively, a number of different operating states of a technical device such as a machine, an installation, a vehicle or the like having at least one visual and/or audible warning element (2), wherein at least one adjusting unit (4) for setting and/or adapting at least one operating parameter of the warning element (2) such as lighting color, color intensity, luminous image, volume, melody, tone sequence or the like is provided, wherein the adjusting unit (4) comprises at least one interface (6, 16) for receiving setting information of the operating parameter, is proposed for improving the configuration or the setting of such devices. According to the invention, this is achieved by the fact that the interface (16) of the adjusting unit (4) is designed as a wave receiver (6) for receiving waves as wireless setting information of the operating parameters.

20 Claims, 1 Drawing Sheet

OPERATING STATE WARNING DEVICE

Figure 1:
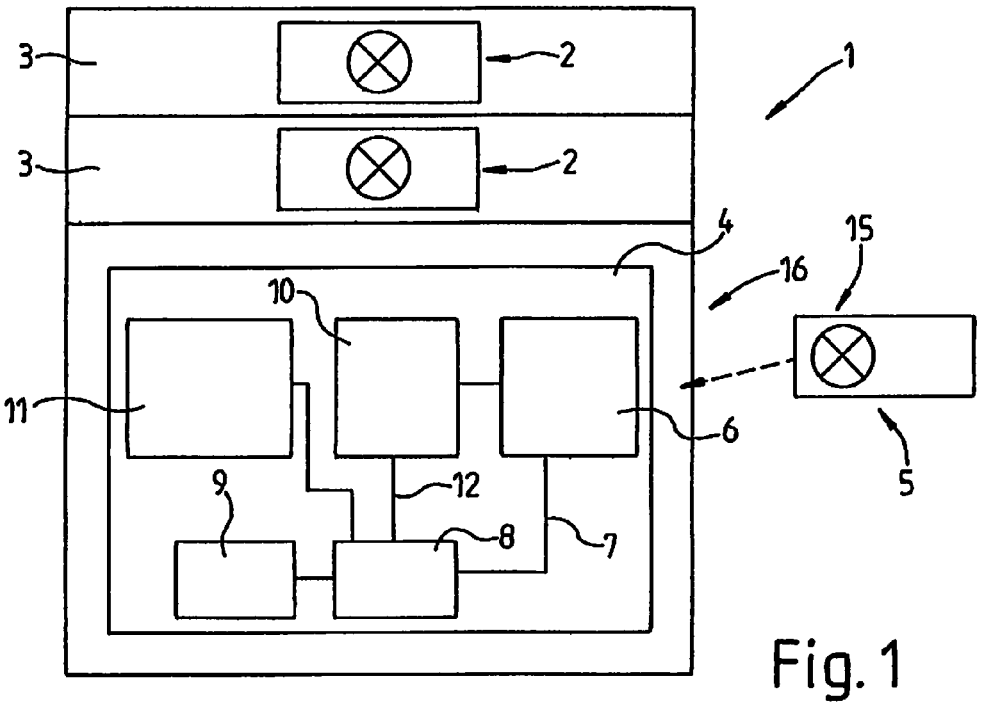

The invention relates to an operating state warning device for the visual and/or audible indication of at least one operating state or, respectively, of a number of different operating states, of a technical apparatus such as a machine, an installation, a vehicle or the like as claimed in the preamble of claim 1.

PRIOR ART

For example, signaling devices such as signaling columns or the like have already been used for years in the most different variants as an operating state warning lamp device. In many cases, the traditional signaling column is equipped with three exchangeable modules which usually have the color combination of red, amber and green. Since signaling columns are frequently constructed like modules, additional exchangeable modules can also easily be accommodated in the colors of blue or white etc. or individual exchangeable modules can also be removed again in the case of changing operating conditions. In many cases, audible signal generators such as piezo electric disks or multi-tone generators or horns etc. are also integrated in the device so that not only visual but also audible signaling can take place.

In recent years, the flexibility of corresponding signaling devices has increased more and more. Thus, for example, with the aid of so-called RGB LEDs, signaling devices are also used which have a uniform calotte and, e.g. in undisturbed operation, only a section of the calotte shines with the color green but in the case of a disturbance, the calotte lights up completely in red. By using RGB LEDs, almost all conceivable luminous colors can also be implemented with corresponding control. Thus, for example, a warning lamp column with RGB LEDs, which is freely configurable with the aid of mechanical switches or a USB interface, as already is known from DE 2007 005 495 U1 of the applicant. This means that the user can configure or modify one or more lighting parameters of the warning lamp depending on the application.

Configuration or adjustment is understood to be an adaptation of one or more lighting parameters of the warning lamp element/s of the signaling device and/or an adjustment or adaptation of corresponding audible warning elements. Usually, a corresponding signaling device is already preconfigured by the manufacturer, i.e. the manufacturer performs a typical basic adjustment of the operating parameters. The user can then to some extent adapt individual or several parameters to his own requirements or situations with the aid of the above-mentioned mechanical switches or via the USB interface. This configuration or adjustment can be performed or changed at any time.

The disadvantageous factor in such signaling devices is, however, that these are arranged to some extent at comparatively inaccessible elevated positions on a machine or in the ceiling area of an operating room so that a change of the operating parameters of a configuration by means of mechanical switches which must be operated manually is cumbersome and requires effort. In addition, the options of configuration possibilities or number of adjustable different operating states are/is also limited by the limited number of corresponding mechanical switches.

Since usually, corresponding signaling devices are operated with 230 volts, corresponding switches or opened devices having internal operating switches must also have contact protection so that no impairment of the manual configuration or hazard to the operating person can arise. Such contact protection measures are both complex and economically disadvantageous.

Configuration by means of an USB interface is also complex and the corresponding cable must be run from a computer up to the signaling device so that here, too, the signaling device must be accessible.

OBJECT AND ADVANTAGES OF THE INVENTION

By contrast, it is the object of the invention to improve the configuration or the adjustment of such devices.

This object is achieved, on the basis of an operating state warning device of the type initially mentioned, by the features of Claim 1. By means of the features mentioned in the sub claims, advantageous embodiments and developments of the invention are possible.

Correspondingly, an operating state warning device according to the invention is characterized by the fact that the interface of the adjusting unit is constructed as a wave receiver for receiving waves as wireless adjustment information of the operating parameters, i.e. especially the lighting parameters and/or the audible parameters of the warning signal.

With the aid of such a wireless adjustment or configuration of the device according to the invention, it is not only a complex and economically disadvantageous contact protection of the device which is dispensable but, instead, it also becomes dispensable that the person who performs the configuration can perform this on the site of the device. This is of great advantage especially for devices and signaling devices which are located at comparatively inaccessible places on a production machine or in the ceiling space of a company building or the like.

In addition, the number of configurable parameters is not dependent on the number of mechanical switches, as in the prior art. Instead, a corresponding wireless adjustment provides for an almost unlimited adjustability or configuration of the device according to the invention. The operating parameters adjustable or adaptable according to the invention can be, e.g., the lighting color, the color intensity, the lighting pattern such as, e.g. flashing or continuous light or flickering, flashlight, all round light etc., sequence or lighting pattern, signal symbols, letters/texts etc., and/or additionally or as an alternative in the case of the use of audible signal elements, e.g. frequency, volume, tone sequence or melody or voice reproduction etc. can be adjusted advantageously by the user.

The power supply of the adjusting unit, or for the configuration, can be implemented, for example, by means of the power supply of the operating state warning device or of the warning light emitting element and/or the audible warning element. The power supply of the adjusting unit is preferably effected by means of a separate power supply unit, i.e. separately from the device-specific power supply of the operating state warning device, or separately from the power supply of the warning element, respectively.

In a special development of the invention, at least one wireless power consumption device for wireless power supply of the adjusting unit by consuming wireless power is provided. By means of this measure, it is made possible that the adjustment or configuration of the operating state warning device or of the signaling device according to the invention can be implemented independently of the operation of the operability of the device or of the warning elements with respect to power. This means that the configuration or adjustment is also possible or effectible with the device-specific power supply switched off.

This aforementioned development, moreover, also has further advantages or opens up novel possibilities such as, e.g., that during the manufacture or production of the operating state warning device according to the invention, among other things in a final phase of the production, a reconfiguration or a basic setting of the operating parameters can be carried out, for example, customer-specifically without great effort. Thus, the basic settings or the reconfiguration of one or a whole series of operating state warning devices according to the invention can be individualized already at the manufacturer without these having to be connected or supplied with a device-specific power supply. This can take place, for example, wirelessly at the end of a manufacturing chain or production line or the like without great effort, for example when moving past a corresponding configurator or an adjusting unit of the manufacturer sending out the waves according to the invention.

The configuration can also be effected, for example, already in the completely packaged state, for example both packaged/closed in a protective plastic film and/or in a carton, with the aid of advantageous waves. The waves can advantageously penetrate the corresponding product packaging so that an individual or customer-specific reconfiguration or adjustment of the operating parameters and the power supply of the configuration can be implemented in the completely packaged state. This has the great advantage, for example, that the manufacture and packaging and storage of operating state warning device according to the invention can be performed with a standardized basic configuration and, for example with an order of corresponding devices, a corresponding customer-specific or altered basic configuration or basic setting can be performed by wireless adjustment transmission unit only on delivery or immediately before delivery. According to the invention, the configuration or adjustment does not require any connecting of the operating state warning device according to the invention, i.e. no unpacking and connecting with a device-specific power supply.

This leads to an advantageous, economically favorable production and storage or delivery and increase in flexibility for the manufacture and/or seller of the operating state warning device according to the invention.

In addition, it is of advantage due to a wireless energy absorption device according to the invention that the operating state warning device can be reconfigured, or the setting can be changed, at the operating site, i.e. for example on or at a production machine or the like without the device-specific power supply having to be in operation. For example, the configuration or setting of the operating parameters according to the invention can be performed with the production machine switched off, for example in the case of refitting of the production machine and/or with the power supply of the operating state warning device according to the invention being switched off.

The absorption device is preferably designed as a wave energy absorption device for absorption of the wave energy of the setting information. As a result, a separate, wireless power receiving device or the like is dispensable. Instead, the energy of the wireless setting information can be used for the power supply of the configuration or change of the setting parameters with the aid of this advantageous variant of the invention. Due to this dual function of the wireless setting information or setting waves, not only the construction but also the economic expenditure for realizing the invention is reduced. In this variant, a largely autonomous mode of operation of the configuration or setting of the operating parameters with respect to the power supply of the device according to the invention or of the warning element/s or the like can be achieved. Such a dual use of the setting information or setting waves can be implemented, for example, with the aid of inductive methods or with the aid of an induction coil or the like.

For example, the wave receiver according to the invention is designed in such a manner that, on the one hand, it forwards the setting information into a microprocessor or the like and/or on the other hand, if necessary, is designed for supplying the microprocessor or the setting process with power with the aid of an advantageous intermediate store or energy store such as, e.g., a battery, a capacitor, an accumulator or the like. Thus, at least one energy store is advantageously provided for storing the wirelessly absorbed energy. As an alternative or in combination therewith, the setting unit can also comprise a separate power supply, e.g. a capacitor, a battery or an accumulator which can be operated essentially independently of the wave receiver and also independently of the device-specific power supply of the device according to the invention.

A correspondingly separate energy store can be periodically exchanged and/or charged up, for example.

In an advantageous embodiment of the invention, the wave receiver is designed for receiving waves, designed as wireless setting information, of a mobile telecommunication device. Mobile telecommunication devices such as so-called mobiles, smartphones, PDAs, portable computers such as laptops, notebooks, tablet computers or the like are already being used in many cases so that a separate setting device for the configuration of the setting according to the invention does not need to be produced or developed. Instead, it is of advantage to adapt mobile telecommunication devices already used by corresponding operators, or to empower these, for example by means of so-called App programming or the like, that they comprise the advantageous functionality or transmitting function according to the invention. This is to say that they can configure a device according to the invention or alter the operating setting, or generate corresponding waves according to the invention.

In principle, an advantageous codification or encryption of the waves or of the setting information is of advantage.

Advantageously, so-called near field communication (NFC) can be used for the wireless or contactless exchange or transmission of the setting information of the operating parameters to the wave receiver of the device according to the invention. For example, a data transmission over relatively short distances of up to approx. 4 cm or up to approx. 1 m range can be realized, for example with a frequency of approx. 13 MHz. The transmission of corresponding electromagnetic waves offers numerous advantages such as, for example, the configuration of the most varied parameters at high transmission safety.

In general, electromagnetic waves for configuration can also be used for supplying (an intermediate store) of the setting unit with power, wherein, for example, in a first phase, the energy store is filled or charged to such an extent until sufficient energy is available for the configuration. In a subsequent or second phase, the configuration or the change of the operating parameters can take place and, for example, be stored in a microelectronic non-volatile memory or in a data memory having a permanent storability. This is preferably performed without the power supply of the warning device according to the invention being utilized.

The data transmission by NFC can be used not only for the configuration but, according to a special development of the invention, also for reading out information such as, for example, reading out of the operating states of the warning elements or of the technical device to be monitored or the like. Corresponding state data or operating data of the device according to the invention or of the technical device to be correspondingly monitored can be read out both cyclically and anticyclically if necessary and conveyed to a computer or server or the like, for example wirelessly. In this context, advantageous networking with a global network and/or other devices according to the invention provide for the most varied evaluation and operating options. Thus, for example, advantageous alerting of corresponding operators, for example of the operations manager of a company or the like and/or a report to a maintenance/repair service or the like can also be implemented by these means.

Advantageously, the wave receiver is designed as a light wave receiver for the optical reception of visible light waves. For example, the light wave receiver can be designed as a camera unit or the like in order to use relatively complex light patterns, colors or even images as setting information for setting the operating parameters. Preferably, a light sensor is used for bright/dark detection. Such bright/dark light sensors such as a photocell or the like are already commercially available and procured very favorably economically. This reduces the economic costs for implementing the invention.

In addition, such a photocell or a light sensor can convert optical light energy into electrical energy and thus be used for the electric power supply of the setting or the configuration. For example, optical light is implemented for generating electrical power for supplying the setting or the configuration by visible light in an energy storage phase. In a subsequent or second phase, the configuration or change of settings can be performed with the correspondingly stored electrical energy. I.e. that the light wave receiver is used both for receiving data and for receiving power and preferably forwards corresponding electrical energy to an intermediate store. For changing, the light wave receiver can forward electrical setting information for configurating or changing the settings, for example, to a microprocessor or the like. With the aid of a non-volatile memory or permanent memory, the new or changed settings can be advantageously stored or deposited permanently.

In an advantageous embodiment of the invention, the wave receiver is designed as flashlight receiver for the reception of codified flashlight of a mobile telecommunication device and/or of a camera flashlight element. As an alternative or in combination therewith, the wave receiver can be advantageously designed also as a screen light receiver for receiving codified screen light of a mobile telecommunication device and/or of a video screen. This means that the device according to the invention, in combination with a mobile telecommunication device, can advantageously perform an optical configuration or setting of the operating parameters.

Present-data communication devices, especially mobile telecommunication devices such as smartphones, PDAs or the like usually have, apart from a screen for displaying corresponding user information, also an inbuilt camera which usually also comprises a camera flash or the like. For this purpose, one or more LEDs are provided, for example, as light flash. According to the invention, this flash unit or the camera flash can advantageously generate or send out codified flashlight which is then advantageously used by the light wave receiver of the device according to the invention for configuring and setting the operating parameters of the operating state warning device.

As an alternative or in combination therewith, the video screen or the touch panel or the like of the telecommunication device or of the smartphone, PDA, tablet or the like can be advantageously be used as transmitter of the setting information. According to the invention, this optical setting information of the video screen of corresponding devices is used by the light wave receiver for performing the configuration or setting of the operating parameters of the operating state warning device.

The aforementioned variants represent completely novel functionalities, on the one hand, of the flashlight and/or, on the other hand, of the video screen of corresponding telecommunication devices or mobile telecommunication devices. With the aid of advantageous programming, for example by means of so-called App programming or the like, such new functionalities of corresponding (mobile) telecommunication devices can be implemented without great expenditure. For example, the manufacture of an operating state warning device according to the invention provides corresponding software or "Apps" for the customer or user of the device according to the invention. This can be achieved, for example, by remote data transmission or internet or the like so that the user can use his mobile telecommunication device (with internet connection) such as a smartphone, tablet or the like, existing, for example, for private reasons, additionally also for the configuration or change of the settings of operating state warning devices according to the invention. By this means, an additional functionality of these units is realized for the configuration according to the invention. Thus, the expenditure for the configuration according to the invention is reduced to a considerable extent and, at the same time, high flexibility is achieved in the configuration.

By means of corresponding codification or modulation and/or encryption of the wireless setting information, high operational reliability is achieved in the configuration. For example, a configuration with a mobile telecommunication device can also be protected against unwanted manipulations by using a password or corresponding access codes.

In principle, the customer/user can carry out or receive the information for a configuration or setting of the operating parameters by internet and/or by "App" or the like and store them on corresponding telecommunication devices and subsequently wirelessly transmit the settings of the configurations to the operating state warning device according to the invention advantageously. An advantageous simulation of the selected settings or the operating parameters "envisaged" can also be simulated and varied, for example, on an internet page, and an "App" or, with the aid of the (mobile) telecommunication device, on the screen. Thus, for example, lighting patterns, lighting colors, color intensity, lighting images or lighting letterings and signal tones, especially their volume, frequency or pulsating, decreasing etc. and/or tone sequences or melodies or the like can be viewed or heard with the aid of the advantageous telecommunication device and/or set or recorded and, according to the invention, wirelessly transmitted to the operating state warning device and the latter, as a result, configured according to the invention or its operating parameters set accordingly.

In principle, an advantageous learning mode can also be provided where, for example, a smartphone or the like recognizes a signal tone and/or a lighting color etc. and accordingly (automatically) changes or replaces the operating parameters.

Apart from the aforementioned advantageous transmission paths of the electromagnetic waves or radio and/or optically by display/video screen or flashlight element, acoustic and/or magnetic transmission paths can also or additionally be provided.

Advantageously, a return message or acknowledgement of the operating state warning device according to the invention after the configuration or after the change of the settings, respectively, is provided. For example, current settings or current configuration information/data are also conveyed back to a (mobile) telecommunication device. Further operating data such as duration of the operation of the device according to the invention and/or of the technical device to be monitored including the operating states or disturbances or interference-free period can also be reported back correspondingly.

ILLUSTRATIVE EMBODIMENT

Figure 2:
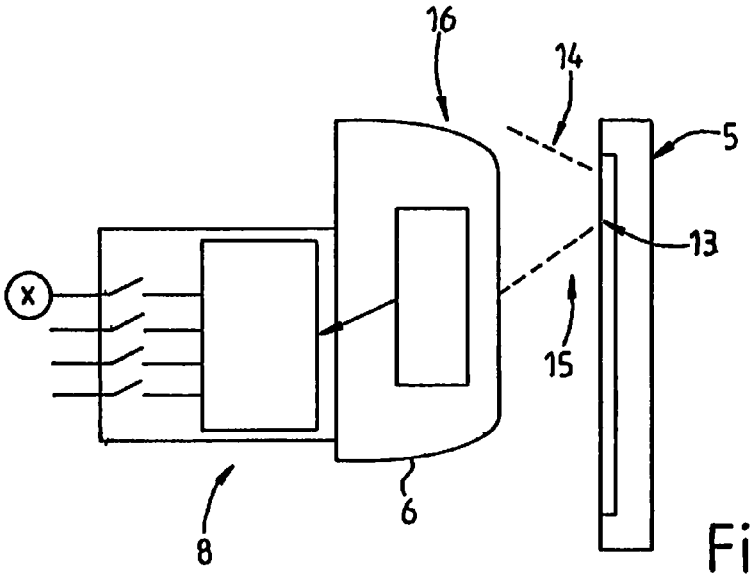

An illustrative embodiment of the invention is shown in the drawing and will be explained in greater detail in the text which follows, with reference to the fears, in which, in detail:

FIG. 1 shows a schematic block diagram of an operating state warning device according to the invention with an adjusting unit and mobile telecommunication device, and FIG. 2 shows a schematic representation of a configuration according to the invention with a Smartphone.

FIG. 1 diagrammatically shows a warning light device 1 with two warning light-emitting elements 2. The warning light-emitting elements 2 are in each case contained in an exchangeable module 3. The warning light device 1 according to FIG. 1 is thus a modular signaling column 1. This is designed for indicating an operating state of a technical device, not shown in greater detail, e.g. in a familiar manner with respect to its modular structure and corresponding exchange of the modules 3 and their power supply or signal supply.

In distinction from signaling columns already known, the signaling device or the operating state warning device 1 according to the invention additionally has an advantageous adjusting unit 4 which is designed for the wireless setting of the operating parameters of the warning light-emitting element 2 or exchangeable module 3. The operating parameters to be adjusted can be, for example, the lighting color, color intensity, the luminous image or the like. Without more detailed representation, an audible signal generator such as, for example, a piezoelectric disk, a signal horn, a loudspeaker or the like can also be additionally present in the signal device 1 and configured, in accordance with the invention.

The configuration or settings of the operating parameters can be implemented in the exemplary embodiment shown in FIG. 1 with the aid of a mobile telecommunication device such as a smartphone 5. For example, the configuration or the transmission of the setting information takes place by near-field communication (NFC) or with the aid of electromagnetic waves, respectively, preferably within a range of about 13 MHz, which are emitted from an interface 15. Such near-field communication (NFC) can take place, for example, over a distance of a few centimeters or up to approx. 1 meter. With the aid of a corresponding NFC data transmission, a bidirectional communication can also be implemented. This means that it is not only possible to transmit setting information to the signaling column or the signaling device 1, but that signals or information such as operating state, operating period or the like can also be transmitted back to the smartphone 5 or its interface 15, respectively. Thus, an acknowledgement of the configuration can also be conveyed to the smartphone 5 or other mobile telecommunication devices.

For the reception of the setting information sent out by the smartphone 5, an interface 16 or a receiver 6, respectively, is provided which converts the waves into electrical signals or data and conveys the setting information to a microprocessor 8 via a data line 7. The microprocessor 8 conveys the setting information or corresponding process data to a non-volatile memory 9 which permanently stores the corresponding parameters or, respectively, in which these are deposited permanently until the next configuration or change, respectively.

According to an advantageous variant of the invention, the receiver 6 is designed not only for the reception of the setting information and the forwarding of their data to the microprocessor 8, but the receiver 6 can advantageously convert the received waves or the received wave energy into electrical energy and forward it preferably to an electrical energy store 10. The store 10 can be, for example, a capacitor, an accumulator or the like.

As an alternative or in combination with the energy store 10, an additional or separate store 11 of the setting unit 4 can be provided which is also designed as a capacitor or accumulator or as a battery.

In one variant according to the invention, an optical light wave transmission according to the invention can also be implemented. This means that the smartphone 5 or a transmitting interface 15 sends out optical, visible light 14 and that an interface 16 according to the invention or the receiver 6, respectively, is designed as a photo receiver 6 or wave interface 16 which can receive optical, visible light 14 and convert it into electrical signals or electrical energy. According to this variant of the embodiment, the interface 16 or the optical wave receiver 6, respectively, or photo receiver 6, respectively, guides the setting information via the electrical data line 7 also to the microprocessor 8.

In addition, the receiver 6 or photo receiver 6, respectively, in this embodiment is also designed for converting the optical light energy into electrical energy for the electrical store 10 and forward it to the latter, the energy store 10 again being connected to the microprocessor 8 via an energy line 12 and providing electrical energy for its power supply. This means that by means of the optical light energy of the smartphone 5 and the energy conversion with the aid of the photo receiver 6, not only wireless settings/information of the lighting parameters can be supplied to the microprocessor 8 via the data line 7, but that this adjustment or configuration can be performed autonomously with respect to energy with the aid of the energy store 10 and/or an additional electric store 11. Correspondingly, the configuration or setting of the lighting parameters and/or of acoustic parameters of the signaling column of the signaling device 1, respectively, can be programmed or performed without external supply voltage. As a result, contact protection as in the prior art is dispensable in which corresponding DIP switches are correspondingly shielded against the supply voltage of the signaling device 1 with 230 volts.

Due to the wireless data transmission or transmission of the setting information of the lighting parameters according to the invention, it is additionally also possible to dispense with easy accessibility of the signal device 1 even in poorly accessible operating sites on a production machine or the like.

By using a smartphone 5 or another mobile telecommunication device, it is also possible to access all of the present devices of the customers of the operator without having to utilize separate devices or devices to be developed and/or to be purchased especially. Instead, a preexisting telecommunication device having the additional functionality, namely the configuration according to the invention of the signaling device 1, is implemented, for example, by means of advantageous programming of corresponding smartphones 5, for example with so-called App programming and/or by internet downloading or the like.

FIG. 2 diagrammatically shows a corresponding configuration situation with the aid of a smartphone 5 or its video screen 17 or flash 13, respectively. In this context, a video screen 13 or a flash 13 of the smartphone 5 is used in such a manner that visible light 14 is generated and advantageously changes in such an advantageous codified manner that the receiver 6 or the photo receiver 6, respectively, receives wireless setting information of the lighting parameters and forwards them to the microprocessor 8 or the logic, respectively. In addition, the data or operating parameters can be advantageously deposited or stored in a corresponding non-volatile memory 9.

For example, in a first phase, light pulses 14 of the smartphone 5 or of the video screen 13 are detected via the photo receiver 6 or a photocell or the like of the signaling device 1 and converted into electrical energy and stored, with the aid of an advantageous intermediate memory, for example the electric store 10, so that the energy store 10 is charged up during this process. The energy store as a result can then be used for the configuration or changing of the setting of the operating parameters.

Accordingly, not only the video screen 13 but also the flash 13 or the flash LEDs of the mobile telecommunication device or of the smartphone 5 can be used correspondingly for the configuration of the signaling device 1. Here, too, the flash light 14 can be converted into electrical energy and stored, for example in an energy storage phase, and subsequently provided for the configuration.

In a particularly economically favorable variant, the interface 16 or the photo receiver 6, respectively, is designed as a light sensor 6 for bright/dark perception.

LIST OF REFERENCE DESIGNATIONS

1 Warning light
2 Warning light-emitting element
3 Exchangeable module
4 Adjusting unit
5 Smartphone
6 Receiver
7 Data line
8 Microprocessor
9 Non-volatile memory
10 Energy store
11 Store
12 Energy line
13 Video screen or flash
14 Light/light pulses
15 Interface
16 Interface

What is claimed is:

1. In an operating state warning device (1) for visually and/or audibly indicating at least one operating state or a number of different operating states of a machine having at least one visual and/or audible warning element (2) and at least one adjusting unit for adjusting and/or adapting at least one operating parameter of the warning element (2) wherein the improvement comprises a non-volatile memory wireless wave receiver adjusting unit (4) with at least one interface (6, 16) to receive setting information for the at least one operating parameter of the warning element and wherein the at least one interface (16) of the non-volatile memory wireless wave receiver adjusting unit (4) has a wave receiver (6) for receiving waves for a wireless setting of the at least one operating parameter of the warning element.

2. The device according to claim 1, further comprising at least one wireless power absorption device to supply power to the non-volatile memory wireless wave receiver adjusting unit (4) by absorbing wireless energy.

3. The device according to claim 1 further comprising at least one energy store (10, 11) for the storage of wirelessly absorbed energy.

4. The device according to claim 1 wherein the wave receiver is a wireless setting device or a mobile telecommunication device.

5. The device according to claim 1 wherein the wave receiver is a light wave receiver for optically receiving visible light waves.

6. The device according to claim 1 wherein the wave receiver is a flashlight receiver for receiving a codified flashlight from a mobile telecommunication device (5) and/or of a camera flash element (13).

7. The device according to claim 1 wherein the wave receiver is a screen light receiver for receiving codified screen light (14) from a mobile telecommunication device (5) and/or a video screen (13).

8. The device according to claim 1 wherein the at least one interface has a wave energy absorption device with an optical interface for the non-volatile memory wireless wave receiver adjusting unit (4) and/or as a photocell (6, 16) and/or as a light sensor (6, 16).

9. The device according to claim 1 further comprising a mobile telecommunication device (5).

10. The device according to claim 9 wherein the mobile telecommunication device (5) has a flashlight element (13) as an interface light wave transmitter (15) for transmitting codified optical setting information (14) to the interface (16) of the non-volatile memory wireless wave receiver adjusting unit (4).

11. The device according to claim 9 wherein the mobile telecommunication device has a video screen and an interface light wave transmitter (15) for transmitting codified optical setting information (14) to the interface (16) of the non-volatile memory wireless wave receiver adjusting unit (4).

12. An apparatus for displaying the operating state of a device comprising:

(a) a warning device housing having an electromechanical connection for at least one visual and/or audible warning element module;

(b) a microprocessor with a non-volatile memory disposed in the warning device housing;

(c) a wireless wave receiver non-volatile memory adjusting unit connected to the microprocessor to wirelessly adjust the non-volatile memory;

(d) a power supply connected to the microprocessor; and (e) a wave receiver connected by a data line to the microprocessor and wireless wave receiver non-volatile memory adjusting unit and a power line connecting the wave receiver to the power supply.

13. The apparatus of claim 12 wherein the power supply is a replaceable power supply.

14. The apparatus of claim 12 wherein the microprocessor, the non-volatile memory, power supply and wave receiver provides for the reconfiguration of the non-volatile memory of the device in a packaged state and/or before delivery to the customer.

15. The apparatus of claim 12 wherein the wave receiver is a light wave receiver.

16. The apparatus of claim 12 further comprising a separate near field wireless adjustment transmission unit to reconfigure the non-volatile memory.

17. The apparatus of claim 16 wherein the wireless adjustment transmission device is a smartphone, a PDA or a portable computer.

18. The apparatus of claim 16 wherein the wave receiver and the separate near field wireless adjustment transmission unit each have an encryption device.

19. A device for visually or audibly indicating the operating state of a machine comprising:

(a) at least one visual and/or audible interchangeable warning element module;

(b) a warning device housing having an outside surface to hold the at least one visual and/or audible interchangeable warning element module;

(c) a microprocessor with a wireless receiver non-volatile memory adjusting unit disposed in the warning device housing;

(d) an internal energy store disposed in the housing and connected to the microprocessor with the wireless receiver non-volatile memory adjusting unit; and (e) a wireless wave receiver connected to the microprocessor to receive data to reconfigure the wireless receiver non-volatile memory adjusting unit to a new set of operating parameters even when the device is in a completely packaged state.

20. The device of claim 19 wherein the wireless wave receiver also receives power and forwards electrical energy to the internal energy store.

* * * * *